US009107560B2

(12) United States Patent
Bauriedl

(10) Patent No.: US 9,107,560 B2
(45) Date of Patent: Aug. 18, 2015

(54) DOOR LATCH FOR AN ELECTRICAL HOUSEHOLD APPLIANCE

(75) Inventor: Josef Bauriedl, Neunburg v. W. (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 146 days.

(21) Appl. No.: 13/295,190

(22) Filed: Nov. 14, 2011

(65) Prior Publication Data

US 2012/0119522 A1 May 17, 2012

(30) Foreign Application Priority Data

Nov. 16, 2010 (DE) ..... 10 2010 051 518

(51) Int. Cl.

| | |
|---|---|
| ***E05C 3/14*** | (2006.01) |
| ***A47L 15/42*** | (2006.01) |
| ***D06F 39/14*** | (2006.01) |
| ***E05B 17/00*** | (2006.01) |
| ***E05B 47/06*** | (2006.01) |
| ***E05C 5/00*** | (2006.01) |
| ***E05C 19/02*** | (2006.01) |

(52) U.S. Cl.

CPC ..... *A47L 15/4259* (2013.01); *D06F 39/14* (2013.01); *E05B 17/0025* (2013.01); *E05B 47/0603* (2013.01); *E05C 5/00* (2013.01); *E05C 19/024* (2013.01); *Y10T 292/1061* (2015.04)

(58) Field of Classification Search

CPC ..... E05C 19/18; E05B 85/16; E05B 83/26; E05B 63/20

USPC ..... 292/288, 336.3, 336, 332, 97–99, 292/DIG. 69, DIG. 26, 228

See application file for complete search history.

(56) References Cited

U.S. PATENT DOCUMENTS

| | | | | |
|---|---|---|---|---|
| 1,263,358 | A * | 4/1918 | Anderson | 292/219 |
| 1,396,163 | A * | 11/1921 | Cleal et al. | 70/98 |
| 3,260,813 | A * | 7/1966 | Dargene | 200/61.64 |
| 4,351,288 | A * | 9/1982 | Gasloli | 126/197 |
| 4,907,831 | A * | 3/1990 | Di Giusto | 292/216 |
| 5,176,417 | A * | 1/1993 | Bauer | 292/201 |
| 5,494,324 | A * | 2/1996 | Kleefeldt | 292/340 |
| 5,520,424 | A * | 5/1996 | Hapke et al. | 292/198 |
| 6,155,616 | A * | 12/2000 | Akright | 292/207 |
| 6,290,270 | B1 | 9/2001 | Spiessl | |
| 6,328,320 | B1 * | 12/2001 | Walski et al. | 280/47.26 |
| 6,390,518 | B1 * | 5/2002 | Elick | 292/216 |
| 7,032,939 | B2 * | 4/2006 | Magnusson | 292/333 |
| 7,210,711 | B2 * | 5/2007 | Dirnberger | 292/68 |
| 2005/0194795 | A1 * | 9/2005 | Hapke et al. | 292/216 |

FOREIGN PATENT DOCUMENTS

DE 19837248 A1 10/2000

* cited by examiner

*Primary Examiner* — Kristina Fulton
*Assistant Examiner* — Nathan Cumar
(74) *Attorney, Agent, or Firm* — Robert R. Deleault, Esq.; Mesmer & Deleault, PLLC

(57) ABSTRACT

A door latch for an electrical household appliance includes a closing spring arrangement which is tensioned in an open position of the door latch and relaxes upon closing of the door, and a gripping unit which grips a closing element upon closing of the door and releases it again upon opening of the door. The gripping unit in the open position of the door latch is in blocking engagement with a blocking element. The closing element upon the closing of the door causes a rotary movement of the gripping unit about an axis of rotation where the gripping unit comes out of blocking engagement with the blocking element. The gripping unit has a base body bearing at least one supporting projection, projecting coaxially with respect to the axis of rotation, for supporting the gripping unit.

20 Claims, 7 Drawing Sheets

DOOR LATCH FOR AN ELECTRICAL HOUSEHOLD APPLIANCE

BACKGROUND OF THE INVENTION

1. Field of the Invention

The present invention relates generally to a door latch for an electrical household appliance such as, for example, a washing machine, dishwashing machine or tumble drier.

2. Description of the Prior Art

In relation to the prior art regarding door latches with pull-shut function, reference is made, for example, to DE 198 37 248 C2, U.S. Pat. No. 6,290,270 B1, US 2005/0194795 A1 and U.S. Pat. No. 6,390,518 B1. A common feature of these documents is the presence of a rotary member which has a gripping section (in the form of a mouth) for gripping a closing element plunging into an entry opening of the latch upon closing of the door and is rotatably mounted on a carrier component. The carrier component is, for example, a lever or a slide; in each case, in all four documents, a plurality of closing springs responsible for the pull-shut function of the latch engage on the carrier component, without exception at a location offset from the axis of rotation of the rotary member.

SUMMARY OF THE INVENTION

In contrast, one embodiment of a door latch of the present invention includes a closing spring arrangement which is tensioned in an open position of the door latch and relaxes upon closing of the door, and a gripping unit which grips a closing element upon closing of the door and releases it again upon opening of the door. The gripping unit in the open position of the door latch is in blocking engagement with a blocking element owing to the force of the closing spring arrangement and thus preventing the relaxation of the closing spring arrangement. The closing element upon the closing of the door causes a rotary movement of the gripping unit about an axis of rotation. Upon this rotary movement, the gripping unit comes out of blocking engagement with the blocking element and thereby enables a relaxation of the closing spring arrangement. The force of the relaxing closing spring arrangement causes a subsequent pull-shut movement of the gripping unit. The gripping unit has a base body with a gripping section for gripping engagement with the closing element. The base body bears at least one supporting projection, projecting coaxially with respect to the axis of rotation, for supporting the gripping unit.

One aspect of the invention provides that the closing spring arrangement has a spring active axis which intersects the supporting projection. Preferably, in each case one supporting projection projects axially on both sides from the base body, the closing spring arrangement having a spring active axis assigned to each supporting projection and intersecting the respective supporting projection. An arrangement of the closing spring arrangement relative to the gripping unit of this type makes it possible to dispense with a rotatable mounting of the gripping unit on a separate carrier component, which for its part is movably held in a housing of the latch. The closing spring arrangement can be supported on the supporting projection or the supporting projections directly or optionally with interposition of an intermediate member, this intermediate member of course providing no radial support for the gripping unit. Instead, each supporting projection rests on such an intermediate member or directly on a section of the closing spring arrangement. Without impairing the functionality and reliability of the door latch, the construction can thus be simplified and the expenditure involved with the production can be reduced.

If an intermediate member is used, it can be produced from a low-friction material or provided with a friction-reducing coating, at least in that region where a supporting projection of the gripping unit rests against it. An example of a low-friction or friction-reducing material which can be used is Teflon.

According to a further aspect of the invention, which can be provided alternatively or additionally to the above-explained relative position between the supporting projection and the spring active axis of the closing spring arrangement, the door latch can comprise a guiding arrangement for guiding the supporting projection during the pull-shut movement of the gripping unit. This guiding arrangement can form a rectilinear guiding path for the supporting projection, although it is not beyond the scope of the invention to provide a path course deviating from a straight line. For example, the guiding arrangement can have a guiding channel or a guiding slot, into which the supporting projection plunges for its guidance.

Further aspects of the invention, which can be realised independently of the other aspects of the invention, provide that the closing spring arrangement is supported on the supporting projection without interposition of further elements or that alternatively the closing spring arrangement is supported on the supporting projection with interposition of an intermediate member, the supporting projection being radially unsupported in relation to the intermediate member.

According to a preferred configuration, the supporting projection is connected in a rotationally fixed manner to the base body of the gripping unit. The supporting projection can, for example, be of peg-like (pin-like) form. According to one variant, the supporting projection is formed by a pin body which is separate from the base body and is inserted into a pin receptacle of the base body. The base body in this case can be produced from a plastics material, while the pin body is formed by a metal pin. According to another variant, the supporting projection can be formed integrally with the base body, it being possible, if desired, for the supporting projection to be reinforced by a reinforcing pin (e.g. made of iron or steel) surrounded by the material of the supporting projection. For example, the reinforcing pin can be encapsulated by injection-moulding of the material of the supporting projection around it. Alternatively, it is conceivable to produce the supporting projection with an insertion hole, into which the reinforcing pin can subsequently be inserted.

According to one embodiment, in each case one supporting projection projects axially on both sides from the base body, the closing spring arrangement comprising in each case one helical compression spring assigned to each supporting projection.

According to another embodiment, the closing spring arrangement can comprise at least one helical tension spring. In this regard, for example, a configuration can be envisaged in which in each case one supporting projection projects axially on both sides from the base body, the closing spring arrangement comprising in each case one helical tension spring segment assigned to each supporting projection, the two helical tension spring segments being part of a common helical tension spring curved in the manner of a U-shape.

Expediently, the door latch has a latch housing, in which the gripping unit and the closing spring arrangement are accommodated. If desired, still further components can be accommodated in the latch housing, for instance components of a locking device, by means of which the gripping unit can be locked in a closing position of the door latch, so that the door latch cannot be opened. Such a locking device in its locked state can block, for example, the gripping unit against a movement opposite the pull-shut movement.

The latch housing can also have an entry opening, into which the closing element plunges upon closing of the door and through which the closing element strikes the gripping unit.

Particularly in the absence of a carrier component rotatably supporting the gripping unit about an axis of rotation, it can be advantageous when the latch housing has at least one guiding shaft formed therein for receiving at least a part of a helical spring associated with the closing spring arrangement. The guiding shaft can be an integrally formed-on part of the latch housing. Guiding formations for guiding the supporting projection during the pull-shut movement of the gripping unit can also be formed on this guiding shaft, for instance in the form of a guiding slot made in the shaft wall or a guiding channel.

DETAILED DESCRIPTION OF THE PREFERRED EMBODIMENT

Figure 1:
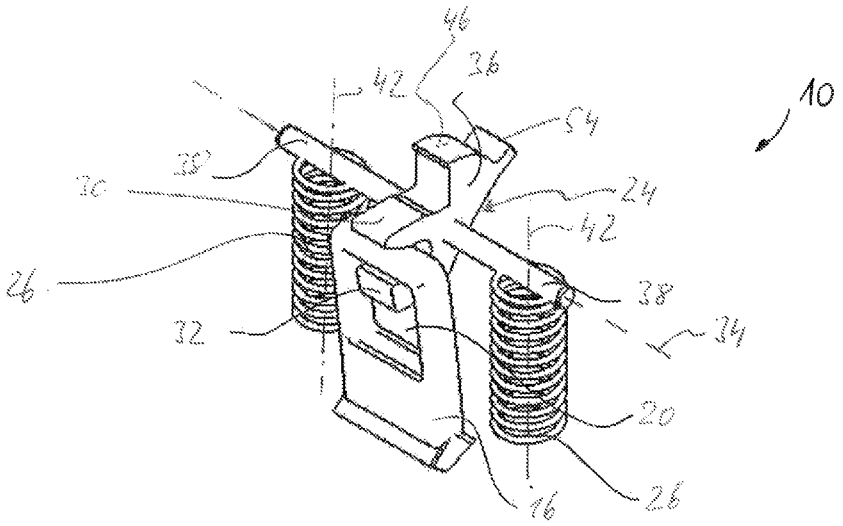
FIG. 1 shows, in perspective, components of a door latch according to a first embodiment.

Reference is first made to FIGS. 1 to 4 and the first embodiment, shown therein, of a door latch generally denoted by 10. The door latch 10 is provided for installation in a washing machine, a dishwashing machine or a tumble drier of the household equipment and serves to keep the door of the household appliance concerned closed. The door latch 10 has a latch housing 12 having an entry opening 14 for a closing element 16 which travels into the entry opening 14 upon closing of the door, the entry direction 14 being indicated in FIGS. 2 and 3*a* by a direction arrow 18 in each case. Passing through the closing element 16 in the region of its leading end is a cutout 20, leaving at the front end of the closing element 16 a cross-piece 22 which can be grasped and firmly held by a gripping unit 24 received in the latch housing 12, in order thus to keep the door of the household appliance in the closed state.

The closing element 16 can be arranged, for example, on the door of the household appliance, while the latch housing 12 with the components accommodated therein can be mounted on a main body of the household appliance, on which the door is usually pivotably fitted. It will be understood that the manner of arranging the closing element 16 and the latch housing 12 can also be reversed if desired, that is to say the closing element 16 can be fitted on the main body of the household appliance and the latch housing 12 can be fitted on the door.

In addition to the gripping unit 24, an arrangement of a plurality of (here two) closing springs 26 is accommodated in the latch housing 12, which springs are tensioned in the open position of the latch (i.e. when the door is open) and relax upon closing of the door and thereby bring about a pull-shut movement of the gripping unit 24, by which the gripping unit 24 is pushed approximately in the direction of the arrow 18 deeper into the latch housing 12, i.e. away from the entry opening 14. Simultaneously with this pull-shut movement of the gripping unit 24, the door of the household appliance is pulled shut, which is comfortable for the user, since the forces required to compress an optionally present door seal do not have to be produced completely by the user him- or herself, but are at least partly provided by the closing springs 26. In the exemplary case shown of the first embodiment, a total of two closing springs 26 are provided, which are both formed as helical compression springs.

The gripping unit 24 forms a gripping mouth (gripping section) 28, into which the closing element 16 plunges with its front cross-piece 22. The gripping mouth 28 is bounded by two jaws 30, 32 opposite one another. In the open position of the door latch, the gripping mouth 28 is open towards the entry opening 14 (cf. illustration in FIG. 3*a*), so that the closing element 16 can travel into the gripping mouth 28, striking with its cross-piece 22 against the jaw 30 and thereby imparting a rotary movement about an axis of rotation 34. The gripping unit 24 has only one axis of rotation 34 as illustrated in FIGS. 1, 3*a*, 3*b*, and 4. In the course of this rotary movement, the other jaw 32 plunges into the cutout 20 of the closing element 16, so that the cross-piece 22 is finally caught in the gripping mouth 28 of the gripping unit 24 (cf. the illustration in FIG. 3*b*).

The gripping mouth 28 is formed on a base body 36 of the gripping unit 24, from which two supporting projections 38, which are pin-shaped in the exemplary case shown, project along the axis of rotation 34 axially on both sides. As can be seen in particular in FIG. 1, the supporting projections 38 are arranged coaxially with respect to the axis of rotation 34. In the case of the first embodiment, the supporting projections 38 are formed materially integrally with the base body 36 of the gripping unit 24, preferably as a plastics injection-moulded part. The supporting projections 38 are in this case connected in a rotationally fixed manner to the base body 36. If desired, a metal reinforcing pin can be located in the interior of the supporting projections 38, which reinforcing pin, for example, can be placed in the injection mould upon injection-moulding of the gripping unit 24 or can be inserted into a hole formed in the supporting projections 38. The reinforcing pin mentioned can extend from one supporting projection 38 through the base body 36 to the other supporting projection 38; of course, it is alternatively conceivable to provide separate reinforcing pins for each of the supporting projections 38.

According to an alternative configuration, not illustrated specifically, the supporting projections 38 can be formed by a separate supporting pin which is produced separately from the base body 36 of the gripping unit 24 and is inserted through a through-hole of the base body. A separate supporting pin of this type can be connected in a rotationally fixed manner to the base body 36, for example, by form fit or friction fit. Of course, it is not beyond the scope of the invention to design the supporting projections 38 rotatably relative to the base body 36 (about the axis of rotation 34).

Figure 2:
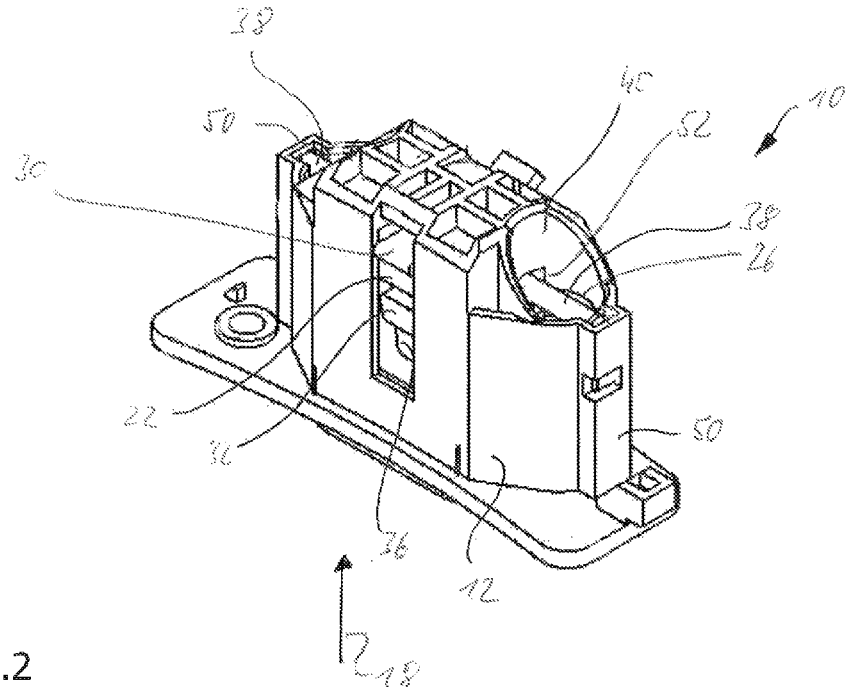
FIG. 2 shows, in a perspective view, the door latch according to the first embodiment with a latch housing.

The latch housing 12 forms for each of the closing springs 26 a guiding shaft (guiding pot) 40, into which the respective closing spring 26 is inserted. The diameter of each guiding shaft 40 preferably corresponds substantially to the outside diameter of the respective closing spring 26, so that the latter is seated substantially without radial play in its guiding shaft 40. In the illustration of FIG. 2, only one of the guiding shafts 40 can be clearly seen; the other is largely hidden owing to the perspective chosen and is therefore not separately denoted.

The closing springs 26 seated in the guiding shafts 40 are supported at one of their spring ends on the housing 12. At their other spring end, they are supported directly on in each case one of the supporting projections 38 in the exemplary case shown. The closing springs 26 here are arranged such that their spring axes—denoted by 42 in FIG. 1—intersect the respective supporting projection 38. In other words, the supporting projections 38 rest so to speak centrally on the closing springs 26 (centrally with respect to the coil centre of the closing springs 26).

Alternatively, it is conceivable to insert between the supporting projections 38 and the closing springs 26 in each case one intermediate member (not illustrated specifically), for instance in the form of an end cap placed on the respective spring end or a slide shoe placed on the respective spring end. The supporting projections 38 are supported in this case on the intermediate members, the support still being provided by merely resting on without use of a radial bearing surrounding the respective supporting projection all around. An intermediate member between the supporting projections 38 and the closing springs 26 can be advantageous particularly when the supporting projections 38 are connected in a rotationally fixed manner to the base body 36 of the gripping unit 24 and upon rotation of the gripping unit 24 therefore frictional forces may arise between the supporting projections 38 and the closing springs 26. For this purpose, the intermediate member can be coated, for example, with Teflon or another suitable low-friction material.

Figure 3A:
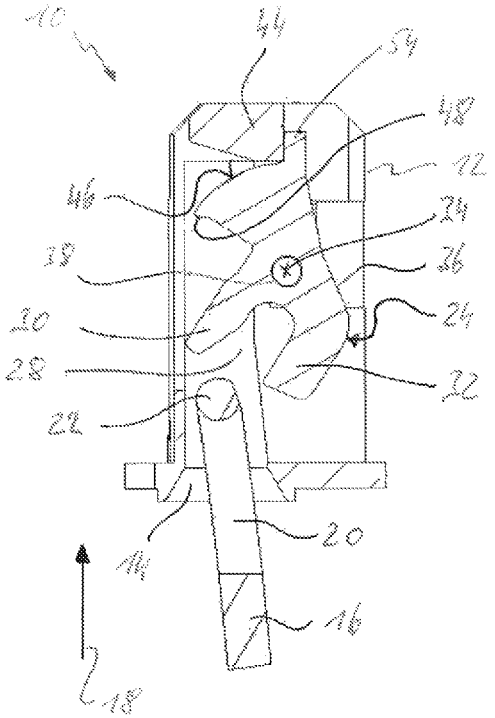
FIGS. 3A and 3B show sectional views of the door latch according to the first embodiment in an open position and a closed position of the latch, respectively.
Figure 3B:
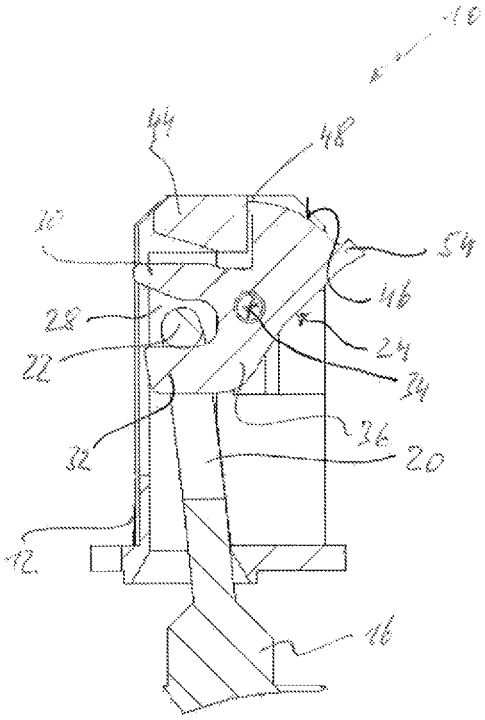
Figure 4:
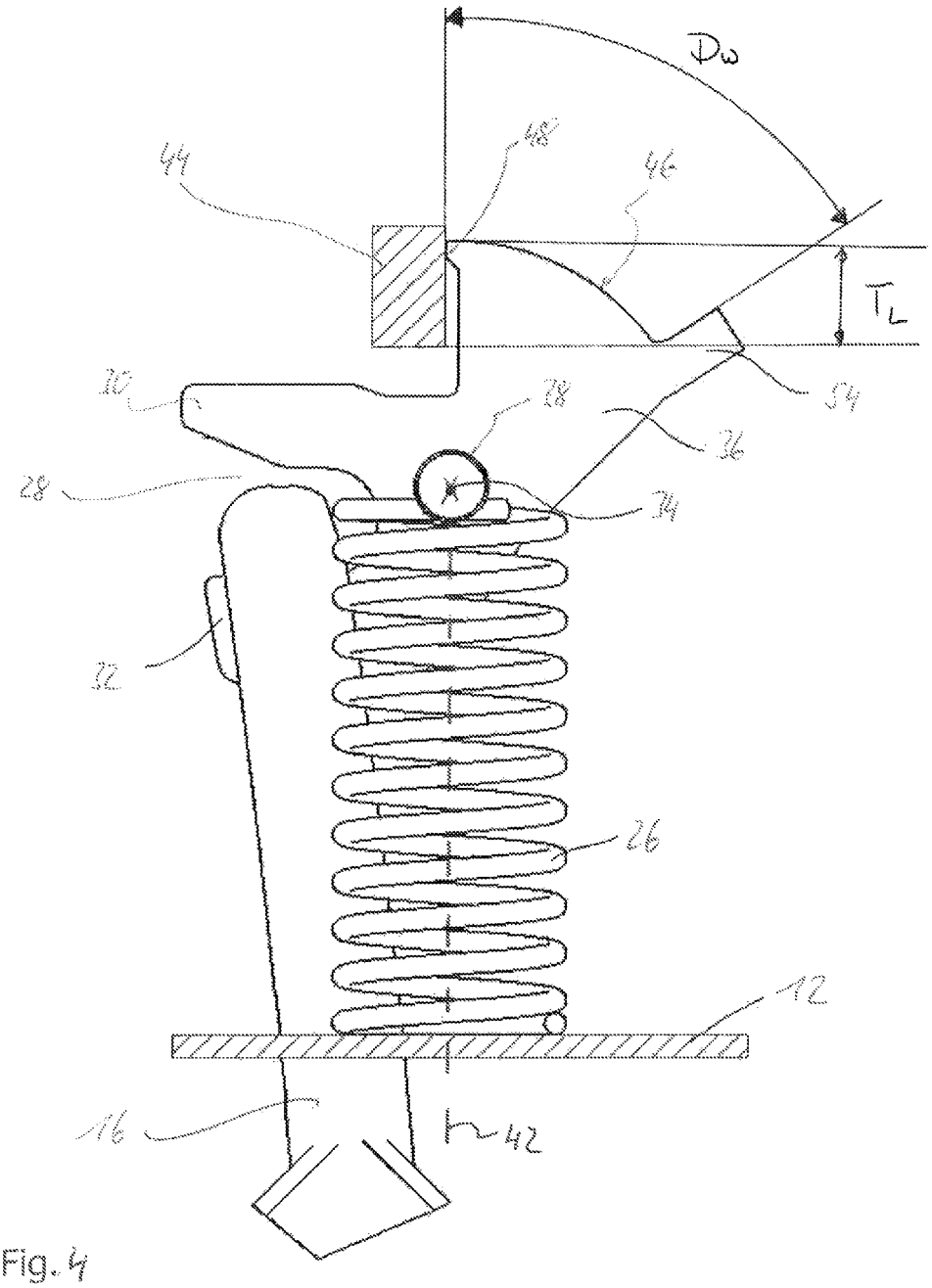
FIG. 4 shows, enlarged, a detail of the door latch according to the first embodiment in the closed position of the same.

The active direction of the closing springs 26, i.e. the direction of their spring axes 42, runs substantially parallel to the entry direction 18 of the closing element 16. In the open position of the door latch according to FIG. 3*a* (corresponding to a release position of the gripping unit 24), the tensioned closing springs 16 push the gripping unit 24 into blocking engagement with a blocking element 44 formed in the case of the first embodiment by a part of the latch housing 12. In the open position of the latch, the gripping unit 24 is supported on this blocking element 44 via a contact surface 46 formed on the base body 36. In the exemplary case shown, the contact surface 46 is designed approximately in the form of a circular arc and allows a rotary movement of the gripping unit 24 about the axis of rotation 34 clockwise (with respect to the viewpoint of FIG. 3*a*) without substantial translatory displacement of the gripping unit 24. Such a rotary movement of the gripping unit 24 takes place—as mentioned—upon closing of the door, as soon as the closing element 16 strikes with its front cross-piece 22 the jaw 30 and thereby sets the gripping unit 24 in rotation. Upon this rotation, the contact surface 46 slides on the blocking element 44 until a sliding edge 48, at which the peripheral line of the base body 36 turns abruptly radially inwards from the contact surface 46, passes the blocking element 44. This allows the closing springs 26 to relax. In doing so, the gripping unit 24 slides under the action of the relaxing closing springs 26 substantially along the direction of the arrow 18 further away from the entry opening 14. Since at this stage the cross-piece 22 of the closing element 16 is caught in the gripping mouth 18 of the gripping unit 24, the closing element 16 is drawn along upon this slipping movement of the gripping unit 24. The door of the household appliance is thus closed tightly. The sliding movement of the gripping unit 24 can also be referred to as a pull-shut movement of the door, since it brings about a pulling-shut of the door. The closing position of the latch is shown in FIG. 3*b*; it corresponds to a gripping position of the gripping unit 24. In this state, the gripping unit 24 can be supported on the blocking element 44 or another part of the latch housing 12.

The pull-shut movement of the gripping unit 24 is preferably a linear movement which is guided by guiding formations formed on the latch housing 12. In the first embodiment, these guiding formations are formed in the region of the guiding shafts 40, in which the closing springs 26 are received. The supporting projections 38 reach transversely through the guiding shafts 40. They are each guided at their free ends in a guiding channel 50, relative to which the wall of the respective guiding shaft 40 is recessed. At the place where the supporting projections 38 enter the guiding shafts 40, the wall of each guiding shaft 40 can additionally have an elongate slot 52 (shown in FIG. 2), which can likewise serve to guide the supporting projections 38 and thus to guide the gripping unit 24 as a whole.

To open the door latch, the user pulls on the door of the household appliance. This produces a force on the gripping unit 24 opposite the direction of the pull-shut movement of the gripping unit 24. The gripping unit 24 thus moves, under ever-increasing tension of the closing springs 26, in the direction towards the entry opening 14 until the contact surface 46 can snap in front of the blocking element 44. This snapping movement can be brought about or assisted, for example, by a pretensioning spring (not illustrated specifically) which pretensions the gripping unit 24 anticlockwise from the viewpoint of FIG. 3*b*. The state according to FIG. 3*a* then results again, an arresting lug 54 formed on the base body 36 limiting the reverse rotation of the gripping unit 24. The angle of rotation covered by the gripping unit 24 between its release position and its gripping position is denoted by $D_W$ in FIG. 4. The translatory travel of the gripping unit 24 upon its pull-shut movement is denoted by $T_L$ in FIG. 4.

In the further figures, identical or identically acting components to those in the first embodiment are denoted by the same reference symbols as previously, but supplemented by a small letter. Unless otherwise stated below, reference is made to the above statements for explaining such identical or identically acting components.

Figure 5:
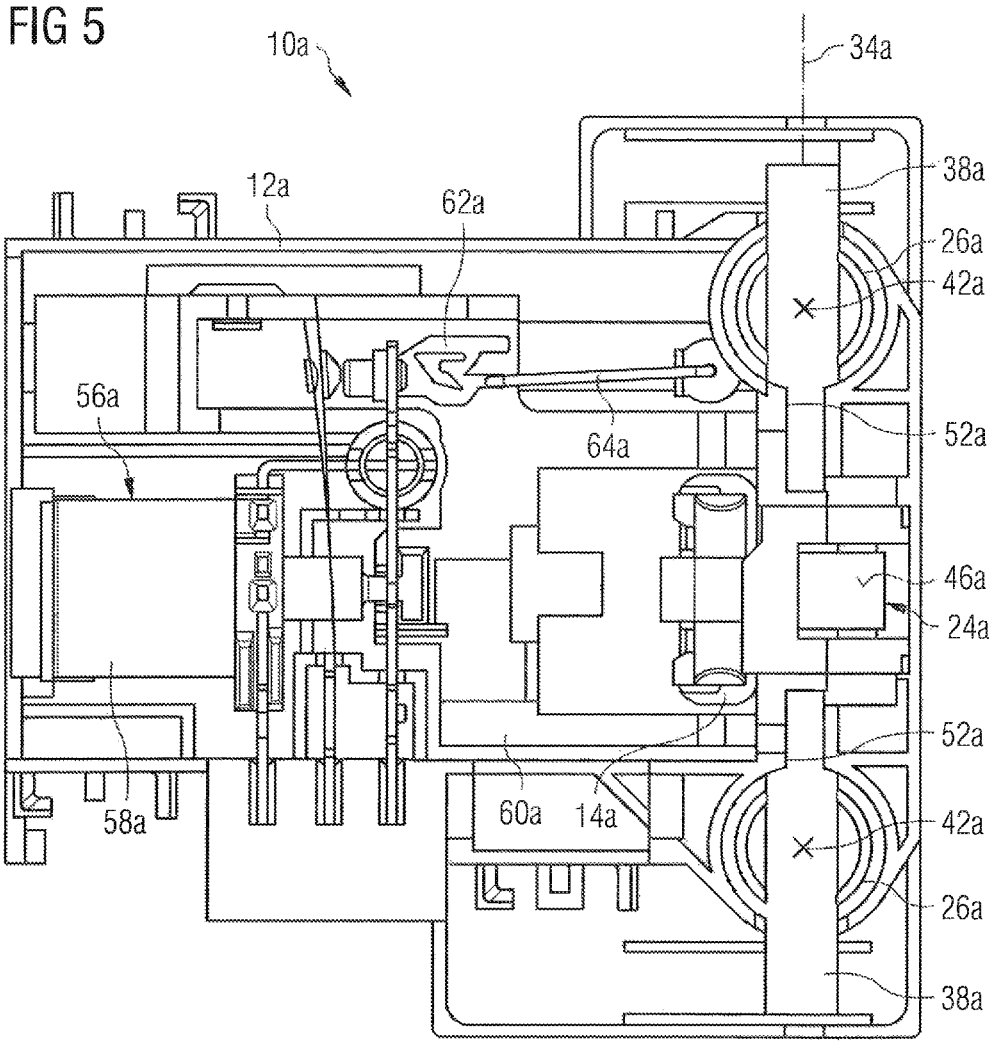
FIG. 5 shows a plan view of a door latch according to a second embodiment.
Figure 6:
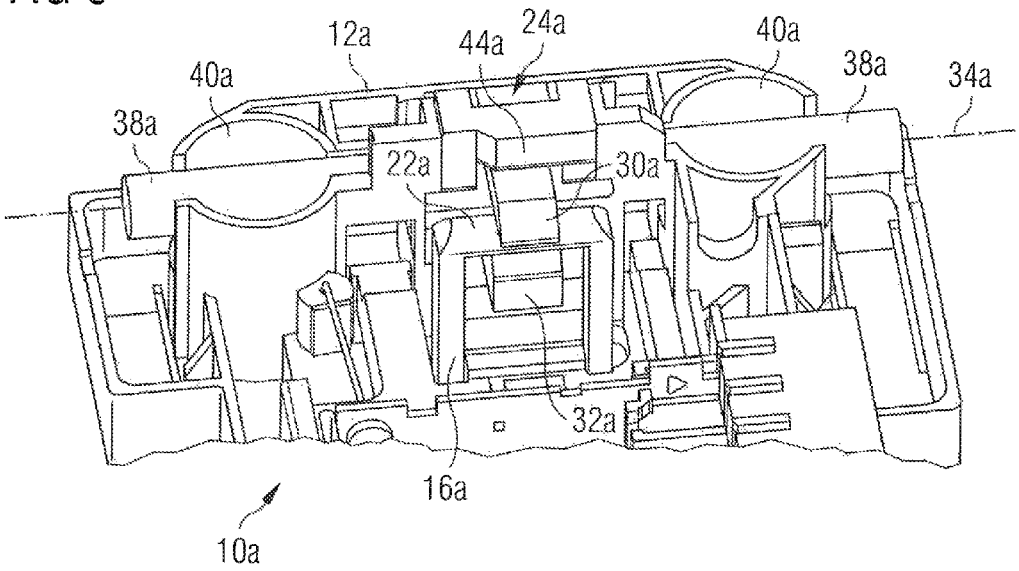
FIG. 6 shows a perspective view of the door latch according to the second embodiment.

The second embodiment shown in FIGS. 5 and 6 differs from the first embodiment essentially by a different configuration of the latch housing 12*a*, this latch housing 12*a* in the second embodiment providing additional space for accommodating components of a locking device, generally denoted by 56*a*, for selectively locking and unlocking the gripping unit 24*a* in its gripping position. The locking device 56*a* is electromagnetically actuated and has a simple-acting electromagnet 58*a* which is to be pulse-actuated by a control unit (not illustrated specifically) and the armature of which is coupled to a linearly movable locking bar 60*a*. A continuous-encircling slotted guide path 62*a*, in which a finger 64*a* mounted on the latch housing 12*a* engages, is formed on the locking bar 60*a*. The slotted guide path 62*a* defines two holding positions, into which the finger 64*a* is alternately moved upon successive actuations of the electromagnet 58*a*. One of these holding positions corresponds to a locking position of the locking bar 60*a*, and the other to an unlocking position of the locking bar 60*a*. In the locking position, the locking bar 60*a* blocks a reverse rotation of the gripping unit 24*a* into the release position, so that the door of the household appliance cannot be opened.

Figure 7:
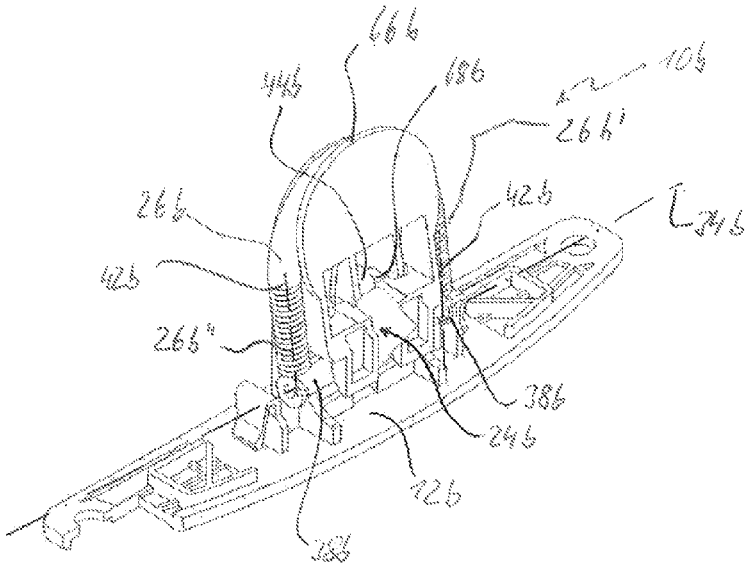
FIG. 7 shows, in perspective, a door latch according to a third embodiment.
Figure 9:
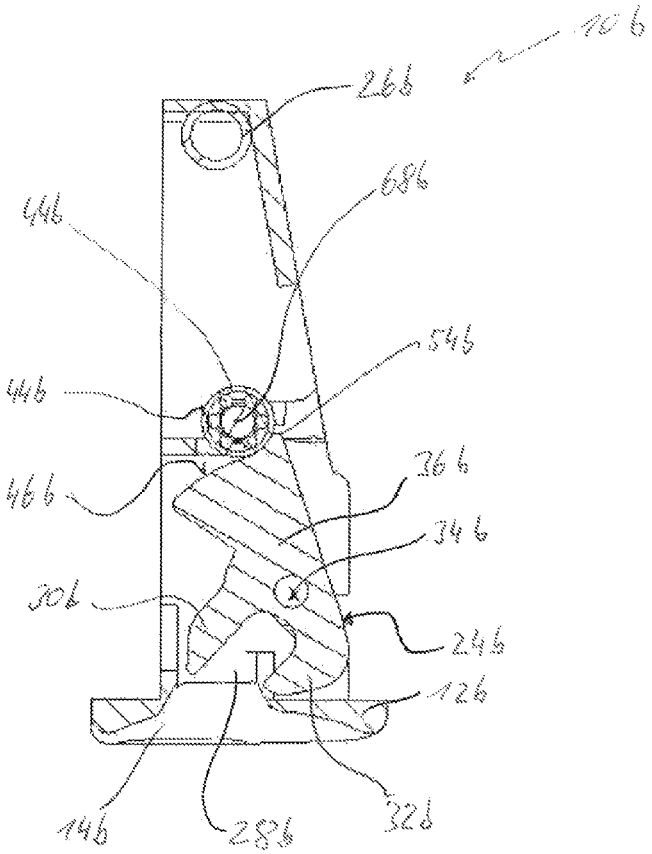
FIG. 9 shows a section through the door latch according to the third embodiment in an open position of the same.
Figure 8:
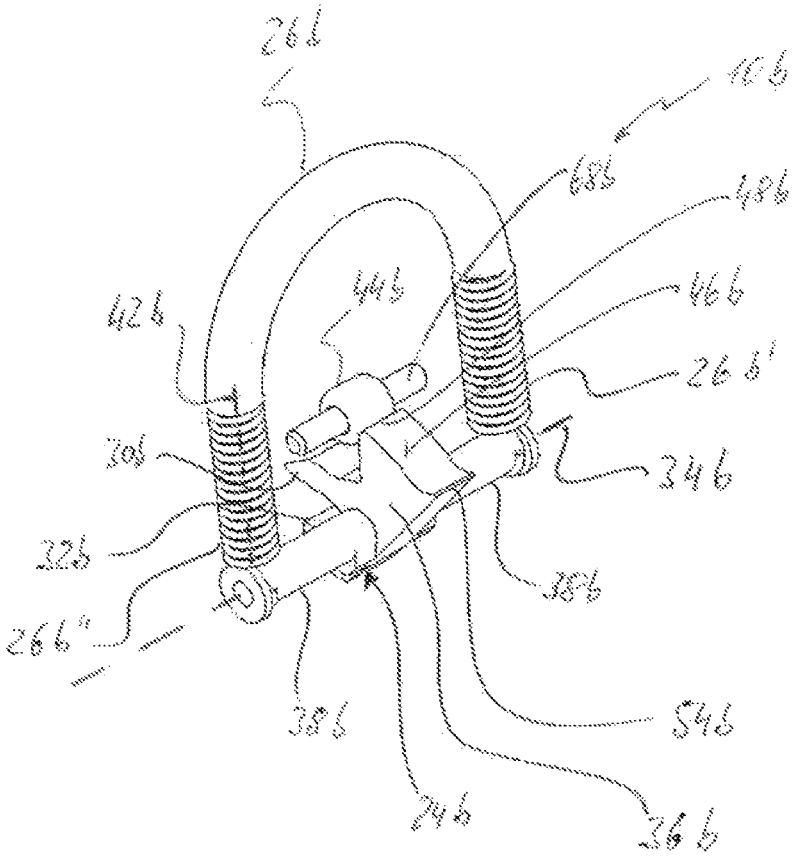
FIG. 8 shows, in perspective, individual components of the door latch according to the third embodiment.

Reference is now made to the third embodiment illustrated in FIGS. 7 to 9. This embodiment differs from the two preceding embodiments by the provision of a helical tension spring as the closing spring 26*b*, in the specific case there being provided a single tension closing spring 26*b* which is curved in the manner of a U-shape and the U-limbs of which each form a spring segment 26*b*', 26*b*" engaging on a supporting projection 38*b*. The tension spring segments 26*b*', 26*b*" are hooked onto their respective supporting projection 38*b*; their active axes 42*b* (cf. FIG. 7) intersect the supporting projections 38*b* as in the preceding embodiments. The direction of the spring force exerted by the closing spring 26*b* on the gripping unit 24*b* corresponds to the active direction of the compression closing springs employed in the first two embodiments.

The closing spring 26*b* is supported in its middle part on a supporting arch 66*b* formed on the latch housing 12*b*. This middle part is illustrated without coils in FIGS. 7 and 8 for reasons of drawing simplicity; it will be understood, however, that the closing spring 26*b* is constructed from helical coils continuously from one spring end to the other.

As an alternative to a single tension closing spring curved in a U-shape, it is conceivable to provide separate tension closing springs which are each hooked onto one of the supporting projections 38*b*.

A further difference compared with the previous two embodiments is the configuration of the blocking element 44*b* in the third embodiment. This blocking element is formed here by a rolling bearing which is arranged on an axle pin 68*b* held on the latch housing 12*b*. Such a configuration of the blocking element 44*b* ensures particularly low friction which is to be overcome upon the rotation of the gripping unit 24*b*. It will be understood that such a configuration of the blocking element may also be employed in the previous embodiments. Conversely, a suitably formed piece of the latch housing 12*b* may also serve as the blocking element 44*b* in the third embodiment.

Otherwise, the functioning of the third embodiment corresponds to that of the first and second embodiment.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for an electrical household appliance, the door latch comprising:

a closing spring arrangement which is tensioned in an open position of the door latch and relaxes upon closing of the door;

a gripping unit which grips a closing element upon closing of the door and releases it again upon opening of the door;

the gripping unit in the open position of the door latch being in blocking engagement with a blocking element owing to the force of the closing spring arrangement and thus preventing the relaxation of the closing spring arrangement;

the closing element upon the closing of the door causing a rotary movement of the gripping unit about an axis of rotation;

the gripping unit upon this rotary movement coming out of blocking engagement with the blocking element and thereby enabling a relaxation of the closing spring arrangement;

the relaxation of the closing spring arrangement causing a subsequent pull-shut movement of the gripping unit, the pull-shut movement including a translatory travel of the gripping unit transverse to the axis of rotation;

the gripping unit having a base body with a gripping section for gripping engagement with the closing element, the base body having at least one supporting projection that directly engages the closing spring arrangement for supporting the gripping unit and wherein the at least one supporting projection projects coaxially with respect to the axis of rotation;

wherein the closing spring arrangement has a spring active axis which always intersects the supporting projection.

2. The door latch according to claim 1, wherein the at least one supporting projection projects axially on both sides from the base body, and the closing spring arrangement has a spring active axis assigned to each supporting projection and intersecting the respective supporting projection.

3. The door latch according to claim 1, further comprising a guiding arrangement for guiding the supporting projection during the pull-shut movement of the gripping unit.

4. The door latch according to claim 3, wherein the guiding arrangement forms a rectilinear guiding path for the supporting projection.

5. The door latch according to claim 3, wherein the guiding arrangement has a guiding channel or a guiding slot, in to which the supporting projection plunges for its guidance.

6. The door latch according to claim 1, wherein the closing spring arrangement is supported on the supporting projection without interposition of further elements.

7. The door latch according to claim 1, wherein the closing spring arrangement is supported on the supporting projection with interposition of an intermediate member, the supporting projection being radially unsupported in relation to the intermediate member.

8. The door latch according to claim 1, wherein the supporting projection is connected in a rotationally fixed manner to the base body.

9. The door latch according to claim 1, wherein the supporting projection (38) is of peg-like form.

10. The door latch according to claim 1, wherein the supporting projection is formed by a pin body which is separate from the base body and is inserted into a pin receptacle of the base body.

11. The door latch according to claim 10, wherein the base body is produced from a plastics material and the pin body is formed by a metal pin.

12. The door latch according to claim 1, wherein the supporting projection is formed integrally with the base body.

13. The door latch according to claim 12, wherein the supporting projection is reinforced by a metal reinforcing pin surrounded by the material of the supporting projection.

14. The door latch according to claim 1, wherein the at least one supporting projection projects axially on both sides from the base body and the closing spring arrangement comprises in each case one helical compression spring assigned to each supporting projection.

15. The door latch according to claim 1, further comprising a latch housing having at least one guiding shaft formed therein for receiving at least a part of a helical spring associated with the closing spring arrangement.

16. The door latch according to claim 15, further comprising a guiding formation for guiding the supporting projection upon the pull-shut movement of the gripping unit is formed on the guiding shaft.

17. The door latch according to claim 4, wherein the guiding arrangement has a guiding channel or a guiding slot in to which the supporting projection plunges for its guidance.

18. The door latch according to claim 2 further comprising a guiding arrangement for guiding the supporting projection during the pull-shut movement of the gripping unit.

19. A door latch for an electrical household appliance, the door latch comprising:

a closing spring arrangement which is tensioned in an open position of the door latch and relaxes upon closing of the door;

a gripping unit which grips a closing element upon closing of the door and releases it again upon opening of the door;

a guiding arrangement for guiding a supporting projection during the pull-shut movement of the gripping unit;

the gripping unit in the open position of the door latch being in blocking engagement with a blocking element owing to the force of the closing spring arrangement and thus preventing the relaxation of the closing spring arrangement;

the closing element upon the closing of the door causing a rotary movement of the gripping unit about an axis of rotation wherein the gripping unit has only one axis of rotation;

the gripping unit upon this rotary movement coming out of blocking engagement with the blocking element and thereby enabling a relaxation of the closing spring arrangement;

the relaxation of the closing spring arrangement causing a subsequent pull-shut movement of the gripping unit, the pull-shut movement including a translatory travel of the entire gripping unit in a linear direction transverse to the axis of rotation;

the gripping unit having a base body with a gripping section for gripping engagement with the closing element, the base body having at least one supporting projection that projects coaxially with respect to the axis of rotation for supporting the gripping unit wherein the closing spring arrangement has a spring active axis which always intersects the supporting projection.

20. A door latch for an electrical household appliance, the door latch comprising:

a closing spring arrangement, which is tensioned in an open position of the door latch and relaxes upon closing of the door, is supported on a supporting projection with interposition of an intermediate member, the supporting projection being radially unsupported in relation to the intermediate member;

a gripping unit which grips a closing element upon closing of the door and releases it again upon opening of the door;

the gripping unit in the open position of the door latch being in blocking engagement with a blocking element owing to the force of the closing spring arrangement and thus preventing the relaxation of the closing spring arrangement;

the closing element upon the closing of the door causing a rotary movement of the gripping unit about an axis of rotation wherein the gripping unit has only one axis of rotation;

the gripping unit upon this rotary movement coming out of blocking engagement with the blocking element and thereby enabling a relaxation of the closing spring arrangement;

the relaxation of the closing spring arrangement causing a subsequent pull-shut movement of the gripping unit, the pull-shut movement including a translatory travel of the entire gripping unit in a linear direction transverse to the axis of rotation;

the gripping unit having a base body with a gripping section for gripping engagement with the closing element, the base body having the supporting projection that projects coaxially with respect to the axis of rotation for supporting the gripping unit wherein the closing spring arrangement has a spring active axis which always intersects the supporting projection.

* * * * *